US006550303B2

(12) United States Patent
Rogers et al.

(10) Patent No.: US 6,550,303 B2
(45) Date of Patent: Apr. 22, 2003

(54) DIE FOR PIPE BENDING APPARATUS

(75) Inventors: John Allen Rogers, Claremore, OK (US); Robert W. Buchanan, Tulsa, OK (US); John Alfred Schrawger, Jr., Tulsa, OK (US); Danny Eugene Ford, Chelsea, OK (US)

(73) Assignee: Dieco Manufacturing, Inc., Tulsa, OK (US)

( * ) Notice: Subject to any disclaimer, the term of this patent is extended or adjusted under 35 U.S.C. 154(b) by 0 days.

(21) Appl. No.: 09/771,381

(22) Filed: Jan. 26, 2001

(65) Prior Publication Data

US 2001/0032489 A1 Oct. 25, 2001

Related U.S. Application Data

(60) Provisional application No. 60/178,112, filed on Jan. 26, 2000.

(51) Int. Cl.[7] ..... B21D 7/10

(52) U.S. Cl. ..... 72/369; 72/380; 72/465.1

(58) Field of Search ..... 72/369, 380, 382, 72/388, 466, 465.1

(56) References Cited

U.S. PATENT DOCUMENTS

| | | | | | |
|---|---|---|---|---|---|
| 2,428,764 | A | * | 10/1947 | Cummings | 72/380 |
| 2,547,870 | A | * | 4/1951 | Kelso | 72/380 |
| 3,834,210 | A | | 9/1974 | Clavin et al. | |
| 4,313,330 | A | | 2/1982 | Cummings | |
| 6,298,706 | B1 | * | 10/2001 | Dunn | 72/369 |

* cited by examiner

*Primary Examiner*—David Jones
(74) *Attorney, Agent, or Firm*—Fellers, Snider, Blankenship, Bailey & Tippens, P.C.

(57) ABSTRACT

A die assembly for machines used to bend lengths of pipe for pipeline applications. The die assembly includes three major components, an exterior housing, a flexible die, and an eggcrate assembly. The exterior housing encompasses the flexible die and eggcrate assembly and pins into conventional bending machines. The flexible die includes a plurality of narrow plate segments positioned along a pair of tie rods. The plate segments are free floating and spaced so as to converge or diverge with respect to the direction of flex of the tie rods. The eggcrate assembly provides support for a plurality of spring plates. Each spring plate has a radius of curvature consistent with the amount of desired bend in the length of pipe.

18 Claims, 9 Drawing Sheets

DIE FOR PIPE BENDING APPARATUS

This application claim Benefit of Provisional application No. 60/178,112 filed Jan. 26, 2002.

BACKGROUND OF THE INVENTION

1. Field of the Invention

This invention relates generally to bending machines and equipment for bending lengths of pipe used in oil, gas, water, and other types of transmission pipelines and specifically to bending dies used in pipe bending machines.

2. Background of the Invention

Conventional dies used in pipe bending machines include half-cylindrical geometries machined so as to have a curve along their length. The radius of curvature of these dies depends upon the diameter of the pipe and have been determined over time. Such radii of curvature as well as known information relating to the recommended degrees of bend are known in the art and can be found on various tables.

A substantial defect inherent in conventional dies is the fact that in practice, the bending force applied is concentrated at one point along the rigid die thereby creating the effect of bending the pipe over a transverse cylinder as opposed to a radius of curvature. The result being the creation of a hot spot on the pipe where the bend occurs. At this spot the pipe weakens from being stretched and also tends to oval in cross-section.

If the bending machine operator is not careful and attentive and pulls too much of a bend, the pipe is known to wrinkle at this hot spot rendering it unusable. The wrinkled section must then be cut out creating waste of very expensive pipe material. As a matter of caution, recommended degrees of bend are small using only a small stroke of the hydraulic cylinders of the bending apparatus. Substantial bends over shorter lengths of pipe result. A need, therefore, exists for a die assembly which includes a flexible die portion to distribute the bending force over a longer length of the pipe thereby creating a uniform bend without hot spots and their attendant ovalization or weakening of the pipe wall. A further need exists for such a die which will further allow greater degrees of bend over longer segments of pipe.

SUMMARY OF THE INVENTION

The die assembly of the present invention includes three major components, an exterior housing, a flexible die, and an eggcrate assembly. The exterior housing encompasses the flexible die and eggcrate assembly and pins into conventional bending machines.

The flexible die includes a plurality of plate segments positioned along a pair of tie rods. Each plate segment is narrow in width and is hung on the tie rods so as to be free floating thereon. The plate segments are arranged so as to provide a space between adjacent plate segments such that flex of the tie rods causes the plate segments to converge on the end in the direction of the flex and diverge (accordian) in the direction opposite the flex.

The eggcrate assembly provides a support for a plurality of spring plates. Each spring plate has a radius of curvature consistent with the amount of bend desired in the pipe. During the bending process, a force is applied by the stiffback of the bending machine against the pipe. The pipe in turn forces the flexible die in contact with the spring plates of the eggcrate assembly. Since each plate segment is independent and free floating on the tie rods, the bending force exerted by the die to the pipe is distributed among the plate segments thereby creating a uniform bend. A plurality of liner bars may be positioned between the plate segments and the pipe to further distribute the force evenly over a greater length of pipe than the conventional die.

An object of the present invention is therefore to provide a die assembly with a flexible die that distributes the bending force over the entire bend.

A further object of the present invention is to provide such a die assembly which may be retrofit into conventional pipe bending machines.

Further objects and advantages of the present invention will become apparent from the specification and claims.

DETAILED DESCRIPTION OF THE PREFERRED EMBODIMENT

The die assembly described with respect to the drawings and specification is designed for use in bending pipe in a pipe bending machine which includes a main frame having connected thereto, directly or indirectly, a stiffback, and stiffback clamp, a pin-up shoe and pin-up clamp and associated power actuating means which are well known and have been described in U.S. Pat. No. 3,834,210, incorporated herein by reference. Therefore, they will not be shown in detail herein.

Figure 1:
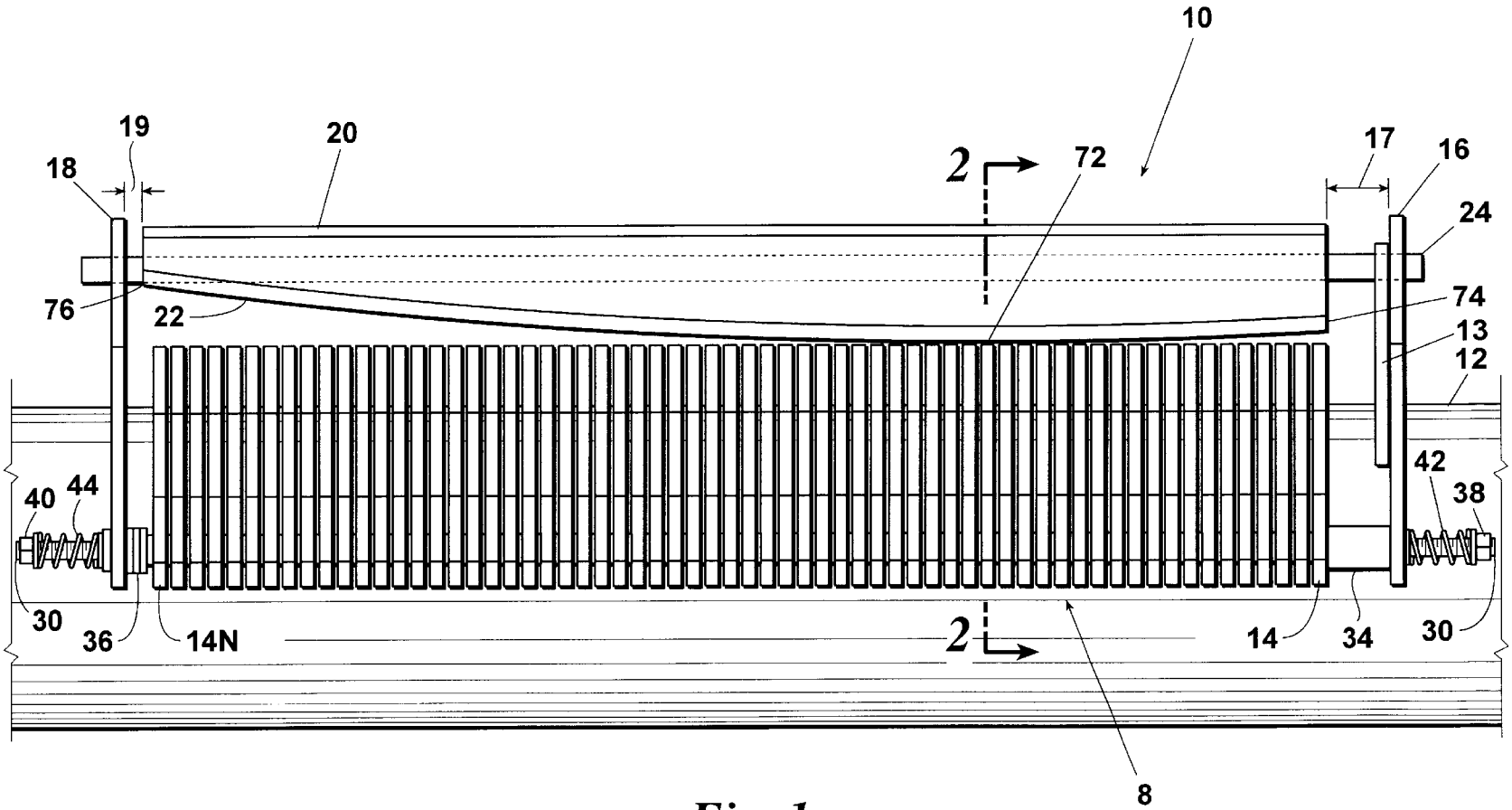
FIG. 1 is a side view detail of the die of the present invention shown on a length of pipe with the die outer housing removed and prior to bending.

Attention is first directed to FIG. 1 which is an elevational view of the die assembly of the present invention shown apart from the pipe bending machine with its external housing removed. Die assembly 10 is shown in a relaxed position resting upon a section of pipe 12 prior to bending. Shown therein, die assembly 10 includes a plurality of essentially identical plate segments 14–14N retained between first end plate 16 and second end plate 18. These plate segments include an arcuate internal shape as will be described in greater detail below with regard to FIG. 2 and are arranged along the length of die assembly 10. Die assembly 10 further includes an eggcrate assembly 20. Eggcrate assembly 20 (described further below) includes a spring plate 22 which is the member which determines the curvature of the bend of pipe 12.

Figure 2:
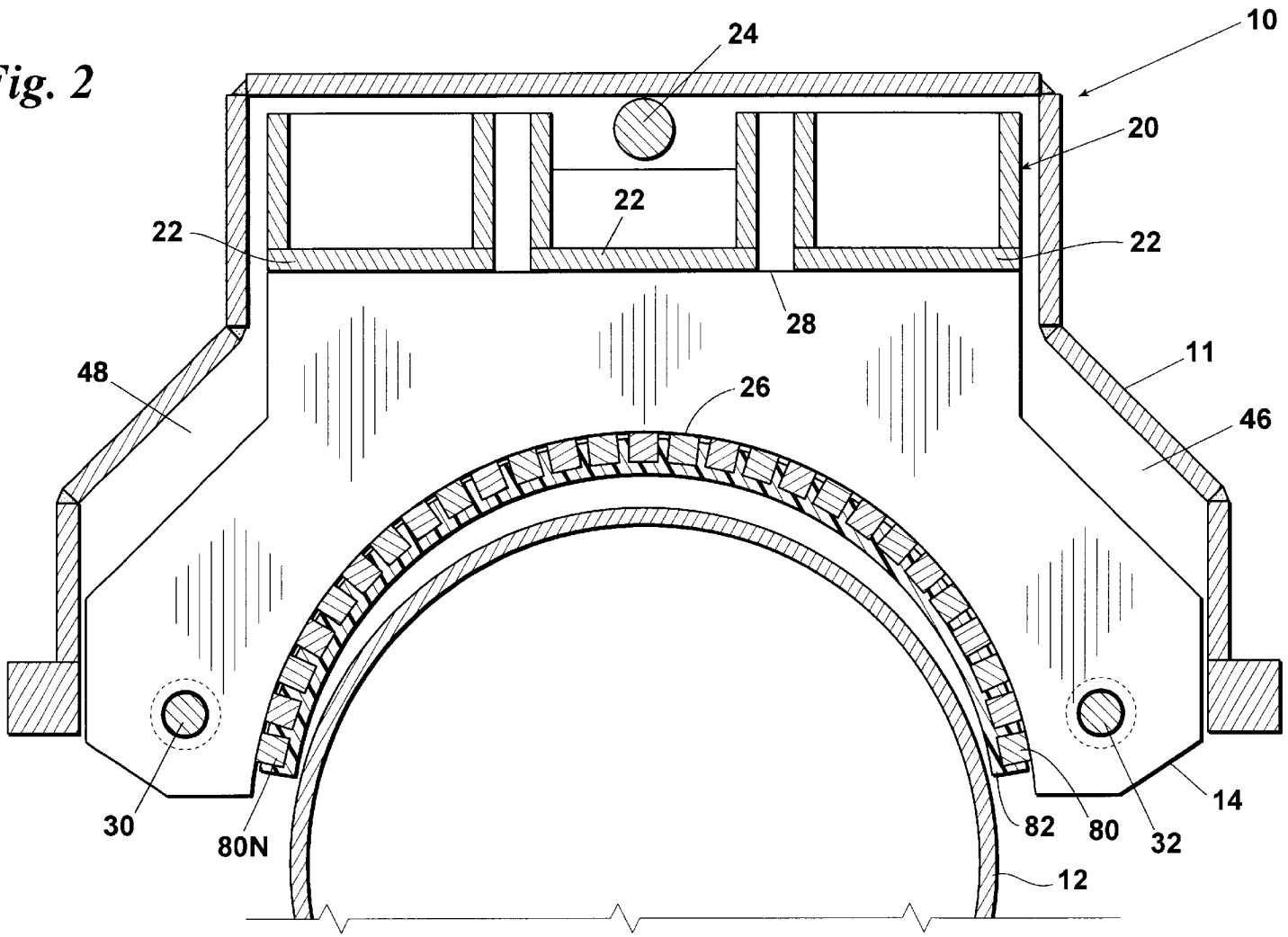
FIG. 2 is a view taken along line A—A of FIG. 1 illustrating one of the interior plates in position prior to bending.

Referencing FIG. 2, a view taken along line A—A of FIG. 1, external housing 11 enshrouds die plates 14–14N and eggcrate assembly 20. External housing 11 is shaped and notched so as to fit into and replace the conventional die in the known pipe bending apparatus such as disclosed in U.S. Pat. No. 3,834, 210. The shape of external housing 11 takes into consideration the supporting structure within the conventional pipe bending apparatus. It is understood that without the limitations imposed by the conventional bender design, external housing 11 and plate segments 14 could be shaped and configured differently without departing from the spirit and scope of this invention.

FIG. 1, when taken in combination with FIG. 2, shows the orientation and geometry of plate segments 14 which shall next be described. Each individual plate segment 14 is shaped so as to include an arcuate cut out 26 therein. Arcuate cut out 26 is sized and shaped to conform to the external circumference of pipe 12 and is dependent upon the size of pipe selected. Each segment plate 14 includes a planer top surface 28 which abuts eggcrate assembly 20.

The die assembly 10 of FIG. 2 is depicted in a relaxed state where no force is applied to pipe 12 against die assembly 10 as when in the bending process. A space 46 and 48 exists between each plate segment 14 and the inside of the external housing 11. The purpose for this is to allow plate segments 14 to move in response to flex of tie rods 30 and 32 and to ensure that plate segments abut against spring plates 22 at top surface 28 and not against exterior housing 11.

The plurality of plate segments 14 through 14N are aligned within die assembly 10 supported from and resting upon a pair of tie rods 30 and 32. Tie rods 30 and 32 extend the length of die assembly 10 through first end plate 16, each individual segment plate 14–14N and out from second end plate 18. Each individual segment plate 14–14N is placed on tie rods 30 and 32 such that a space exists between each individual segment plate 14–14N. In the preferred embodiment, these spaces are maintained through the use of a series of small metal shims or spacers inserted between each individual segment plate. As a result, plate segments 14–14N are substantially free floating on tie rods 30 and 32 and not connected to one another. When assembled, flexible die 8 is not rigid but rather highly flexible.

Tie rods 30 and 32 are capable of substantial flex along their respective longitudinal axes. In the preferred embodiment, tie rods 30 and 32 are constructed of 5160 spring steel, commercially available. However, it is understood that other suitable known flexible materials could be substituted.

A spacer 34 is inserted on each tie rod 30 and 32 between end plate 16 and plate segment 14. Similarly, three washers 36 or other suitable bushing materials are positioned on each tie rod 30 and 32 between segment plate 14N and second end plate 18. Accordingly, plate segments 14–14N are "sandwiched" between spacer 34 and bushing 36 along tie rods 30 and 32 and maintained in free floating alignment thereon. Gaps 17 and 19 are created by spacers 34 and 36 along the lengths of tie rods 30 and 32. Gaps 17 and 19 are contemplated to allow die assembly 10 to be retrofit into the conventional pipe bender apparatus which typically includes two arcuate supports which bound and secure the conventional die. Since in the preferred embodiment, die assembly 10 is longer than the conventional die, the assembly must allow for, and integrate, these supports without the necessity of extensive machining or modification for retrofit of the bender apparatus.

The number and position of plate segments of 14–14N corresponds to the length of eggcrate assembly 20 and is determined by the diameter of pipe selected. The radius of curvature of spring plate 22 will vary according to the diameter of pipe selected.

The ends of tie rods 30 and 32 are threaded to receive nuts 38 and 40 thereon. A spring 42 is inserted between nut 38 and end plate 16. Likewise, a spring 44 is inserted between nut 40 and end plate 18. It is understood that although only tie rod 30 is illustrated in FIG. 1, tie rods 30 and 32 are assembled in identical manner. Springs 42 and 44 apply pressure to end plate 16 and 18 toward plate segments 14–14N but allow plate segments 14–14N to move along the length of tie rods 30 and 32 when tie rods 30 and 32 flex.

Accordingly, an assembly is described wherein plate segments 14–14N are sandwiched between end plates 16 and 18 with spaces between each individual plate segment 14–14N wherein each plate segment floats, or moves freely with regard to its adjacent plate segment in response to flex of tie rods 30 and 32. The free floating plate assembly allows the pressure point (hotspot) applied to the pipe during the bend to move and be distributed along the length of the die from one plate segment to another.

Die assembly 10 is pinned into the bending machine by shaft 24 in a conventional manner. A shaft 24 pins die assembly 10 within the bending machine. Shaft 24 extends through first end plate 16, eggcrate assembly 20 and out of second end plate 18. The die assembly hangs inside the bender from shaft 24 while the eggcrate assembly is bolted to the exterior housing.

Figure 3:
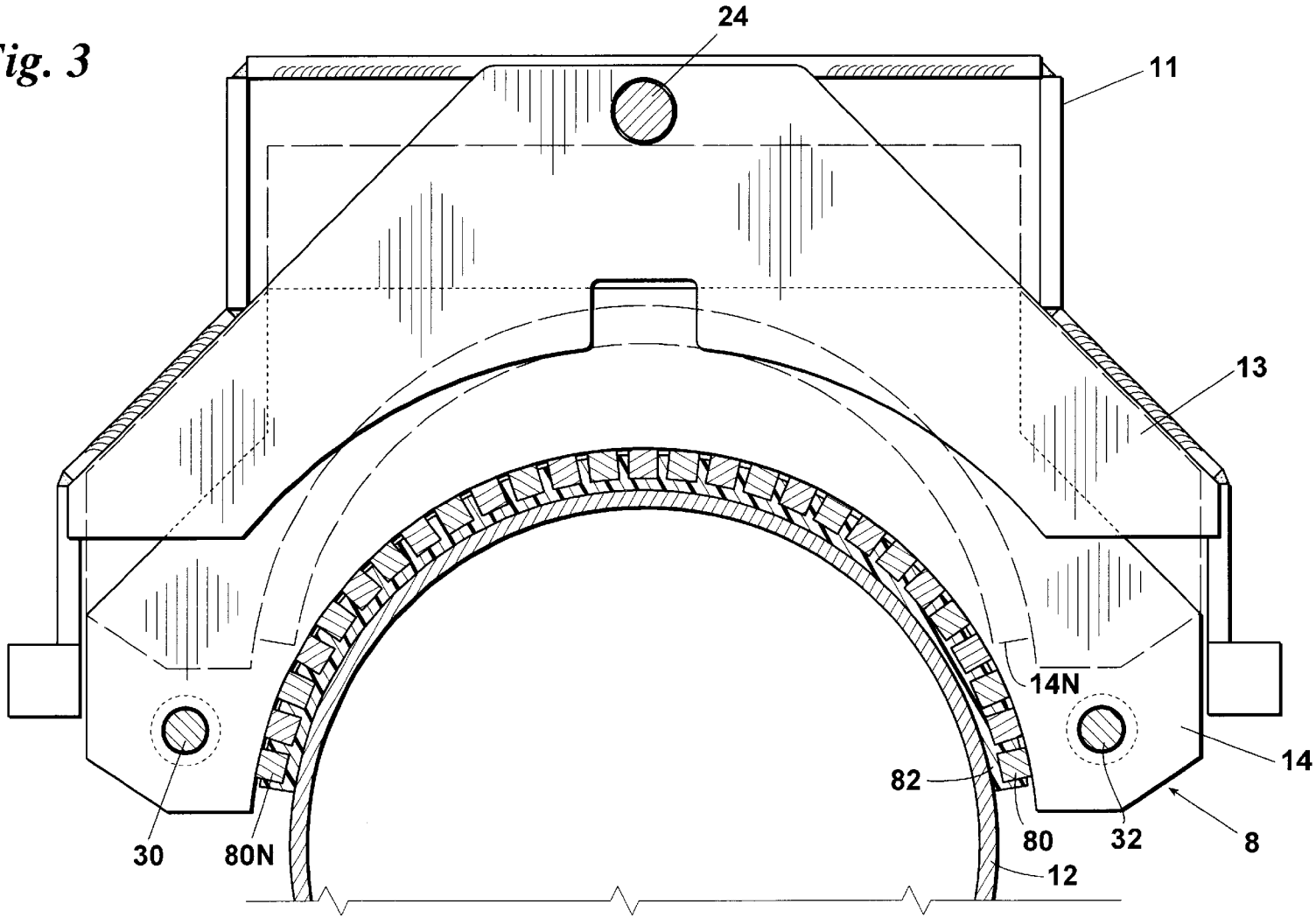
FIG. 3 is an end view cross-sectional of the die of FIG. 1.

Referring to FIG. 3, a section taken just inboard of first end plate 16 which depicts external housing 11 and includes a housing face 13 thereon. Housing face 13 is secured to external housing 11 such as by welding or other suitable means and is an integral part thereof. Flexible die 8 including plate segments 14–14N are within external housing 11. A housing face is likewise secured to external housing 11 on the opposite end (FIG. 4).

Figure 4:
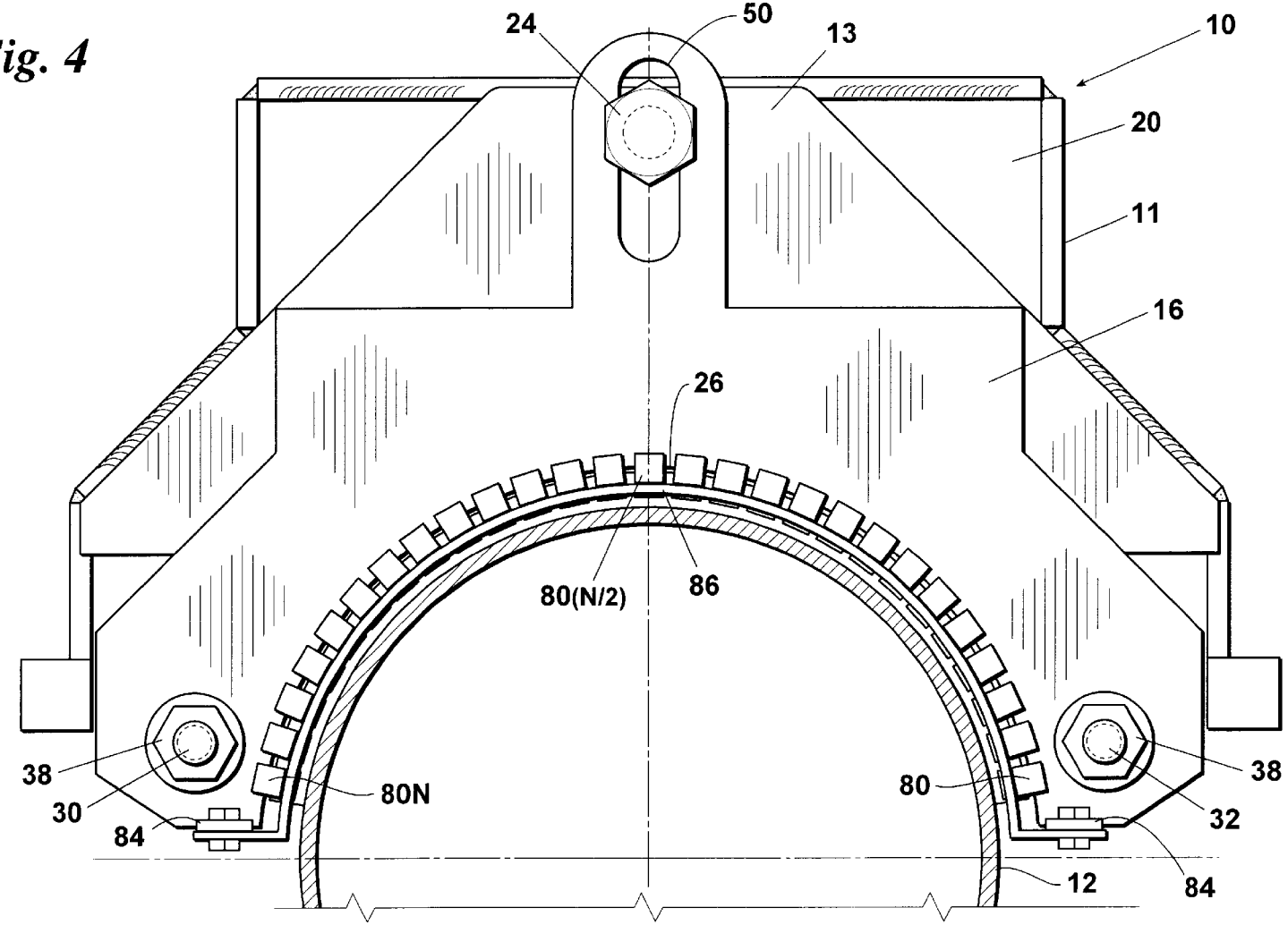
FIG. 4 is an end elevation of the die of FIG. 1.

FIG. 4 is an assembled end elevation of die assembly 10 surrounding a pipeline pipe 12. Die assembly 10 includes external housing 11 with housing face 13 thereon wherein the flexible die 8 (of FIG. 3) is retained within external housing 11. FIG. 4 shows first end plate 16 adjacent housing face 13. Tie rods 30 and 32 are shown extending through first end plate 16 but not through housing face 13. This is so that flexible die 8 as well as tie rods 30 and 32 are able to flex freely within external housing 11 and not retained thereby.

Shaft 24 is shown extending through first end plate 16 and housing face 13 and into eggcrate assembly 20 (as depicted in FIG. 1). As stated previously, shaft 24 secures and suspends die assembly 10 within the bending apparatus. Shaft 24 extends through an oval channel 50 in first end plate 16. Oval channel 50 allows first end plate 16 to move vertically in response to flex of tie rods 30 and 32 so that shaft 24 does not hinder the flex- of tie rods 30 and 32 in the entirety of flexible die 8 within external housing 11.

Figure 5:
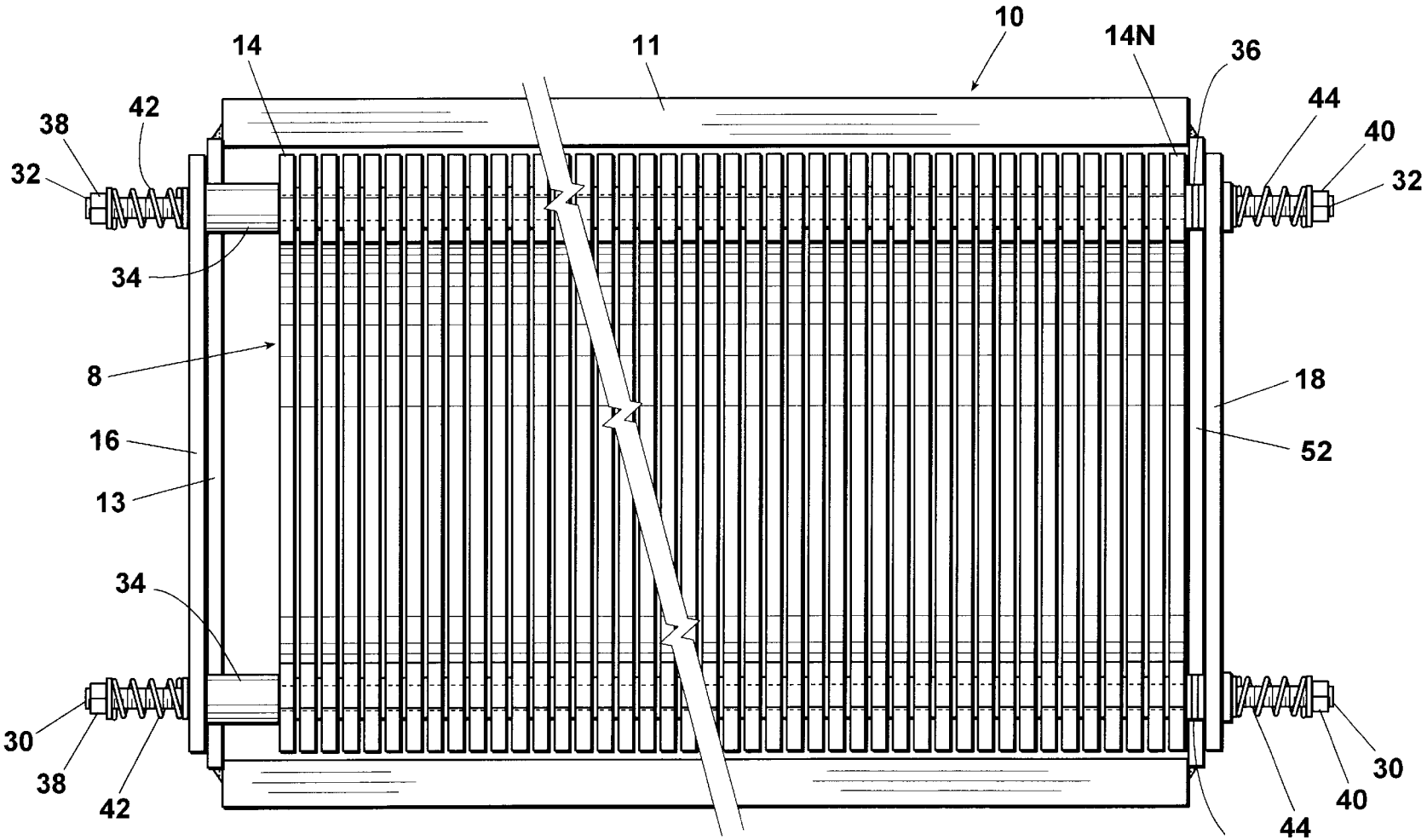
FIG. 5 is a bottom view of the die of the present invention wherein the liner bars are not shown.

FIG. 5 is a bottom view of die assembly 10 which depicts external housing 11 including housing face 13 and housing back 52. Flexible die 8 is shown positioned within external housing 11 in an assembled fashion with the exception that FIG. 5 does not show the liner bars (discussed below). Plate segments 14–14N are shown positioned within housing 11 aligned along tie rods 30 and 32 with spaces therebetween so that each individual liner plate segment is capable of independent movement with respect to its adjacent plate segments in response to flex of liner bars 30 and/or 32. FIG. 5 shows the manner in which plate segments 14–14N are free floating along tie rods 30 and 32 while being retained or sandwiched between first end plate 16 and second end plate 18 of flexible die 8.

Figure 6:
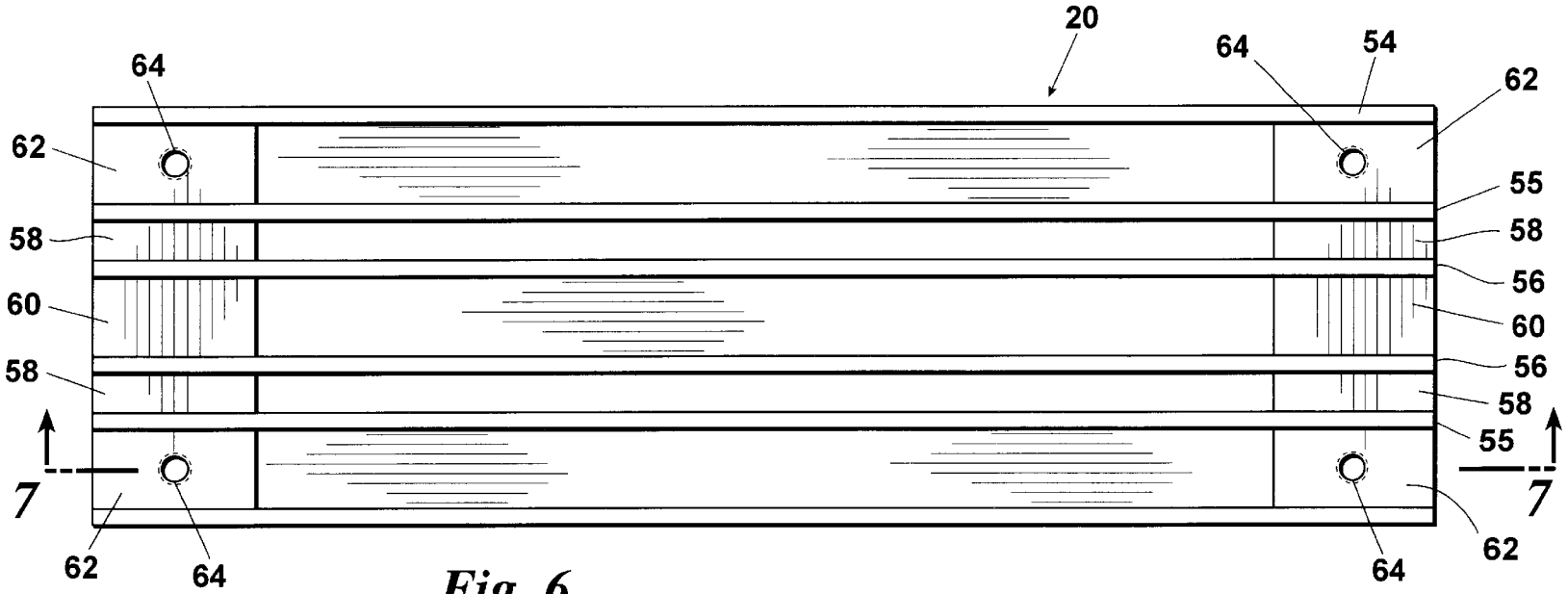
FIG. 6 is a top plan view detail of the eggcrate assembly of the die of FIG. 1.

With reference to FIG. 6, eggcrate assembly 20 shall now be discussed. FIG. 6 is a top plan view of eggcrate assembly 20 which includes a substantially rectangular welded frame 54 with a plurality of support ribs 55 and 56 welded longitudinally therein. Ribs 55 and 56 provide structural support to eggcrate assembly 20 and also provide structural support for the spring plates secured onto eggcrate assembly 20. The number of ribs 56 is dependent upon the size of the eggcrate which varies according the diameter of pipe which is to be bent. A series of cross-supports 58 are welded within frame 54 between ribs 56 to provide additional support. A pair of middle cross-supports 60 are welded between middle ribs 56 but are recessed within frame 54 so as to allow shaft 24 (of FIG. 2) to extend along the length of eggcrate assembly 20 when the die is assembled. A mounting plate 62 is welded on each corner of eggcrate assembly 20 within frame 54. Mounting plate 62 includes a hole 64 drilled and tapped therein. Holes 64 on mounting plate 62 align with holes drilled in the exterior housing of the die assembly so that eggcrate assembly 20 is bolted within the exterior housing upon assembly of the die.

A plurality of spring plate mounting plates 68 are welded within the framework of eggcrate assembly 20. Spring plates 66 are screwed onto spring plate mounting plates 68 by screws 70 countersunk into the surface of spring plates 66.

Figure 7:
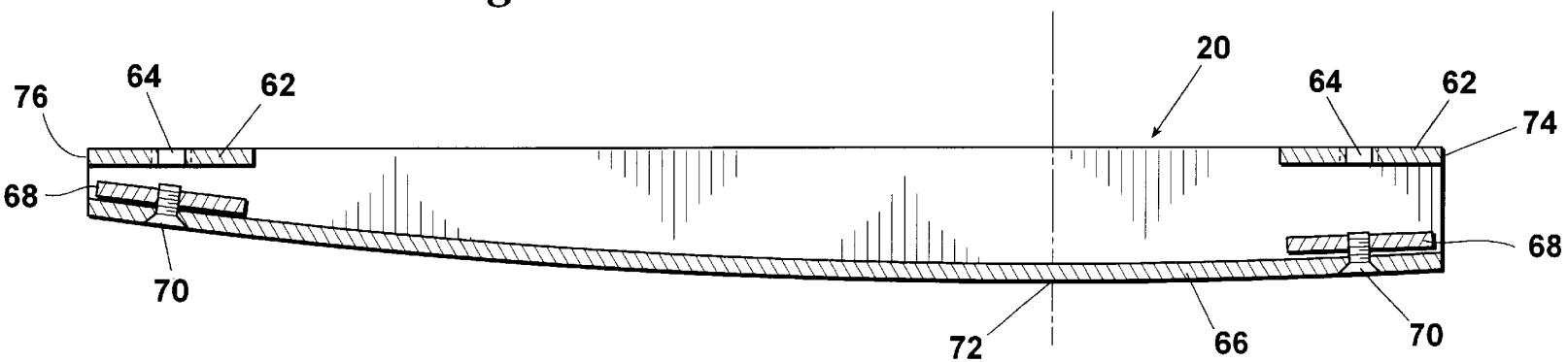
FIG. 7 is a side view of the eggcrate assembly of FIG. 7.

FIG. 7 is a view taken along line 7—7 of FIG. 6 and depicts the manner in which the spring plates 66 are secured to eggcrate assembly 20. Spring plates 66 are a series of spring steel plates machined to a predetermined external radius and bolted to eggcrate assembly 20. In a preferred embodiment, three or more such spring plates 66 are bolted to eggcrate assembly 20 to substantially cover its width. Spring plates 66 form the structure against which flexible die 8 is pressed against during the bending process. The radius of curvature of spring plates 66 determines the radius of curvature of the resulting bend in the pipe.

The fulcrum point 72 of spring plate 66 is positioned toward the pin-up end 74 of eggcrate assembly 20. It is at this fulcrum point 72 that the radius of curvature of spring plate 66 is determined. Since the fulcrum point 72 is positioned closer to pin-up end 74 then stiffback end 76 of eggcrate assembly 20, the radius of curvature intersection with pin-up end 74 means that eggcrate assembly 20 will be thicker at pin-up end 74 than stiffback end 76 since spring plate 66 follows the radius of curvature as set from fulcrum point 72. It is known in the art that a certain amount of bend can be achieved by the pin-up clamp on pin-up end 74.

Figure 8:
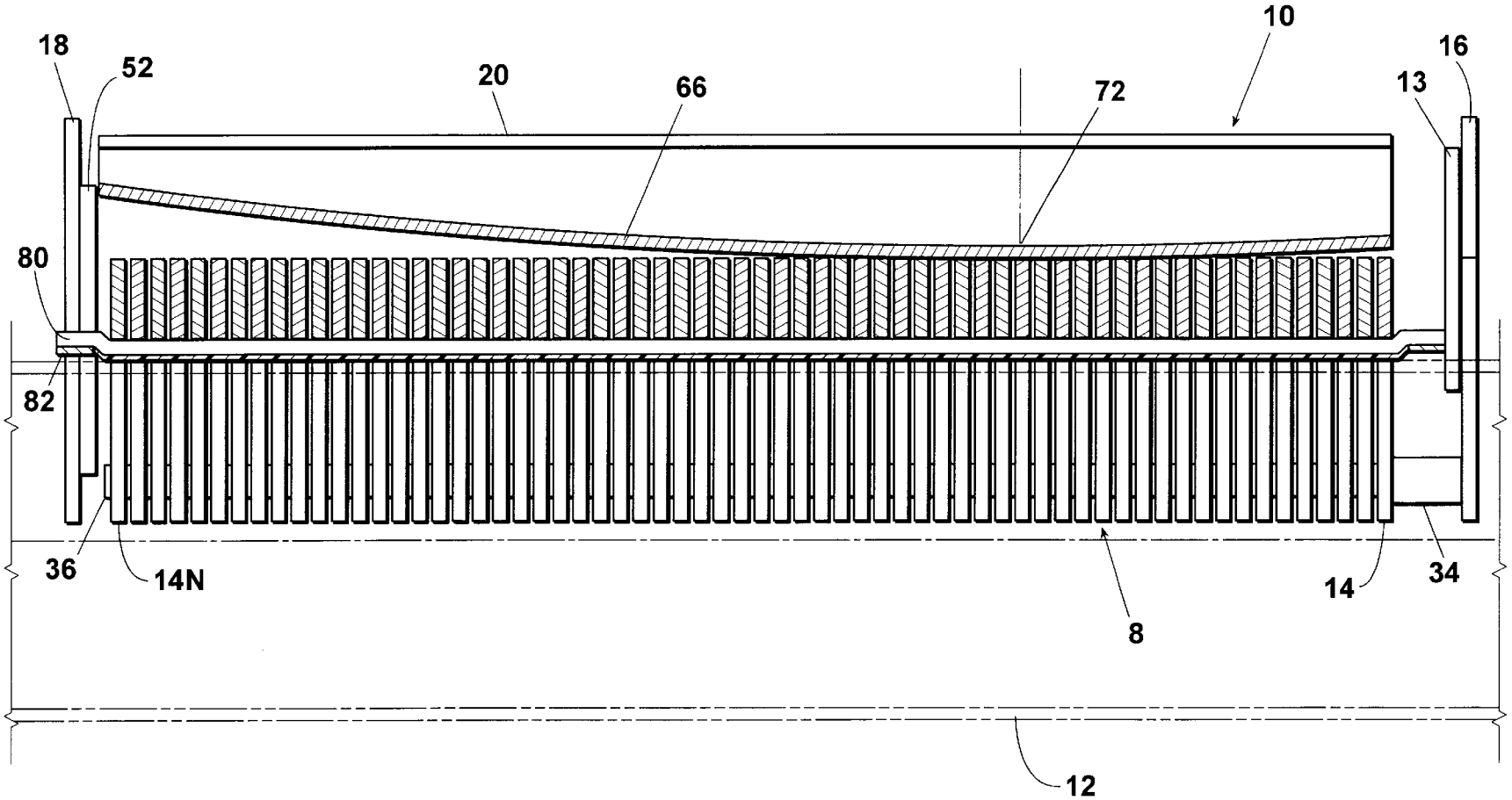
FIG. 8 is an elevational cross-section of the die of FIG. 1.

FIG. 8 is an elevational cross-section of the die assembly 10 of the present invention in a relaxed state prior to bending. Flexible die 8 of die assembly 10 may also include a plurality of liner bars positioned within the arcuate cut-out portion of the plate segments 14–14N. Referring to FIG. 8 with combination of FIG. 2, a plurality of liner bars 80–80N. Liner bars 80–80N are in the preferred embodiment ½"x½"4140 heat treated spring steel which extends the length of flexible die 8 between first end plate 16 and second end plate 18. Liner bars 80–80N contact pipe 12 between the individual plate segments 14–14N and pipe 12. Liner bars 80–80N are flexible so as to be able to flex in accordance with the flex of tie rods 30 and 32. Liner bars 80–80N are preferably coated with a material such as urethane in order to minimize the potential of scratching or scarring to the exterior of pipe 12 which may otherwise be caused by metal-to- metal contact between the flexible die 8 and the pipe 12.

Liner bars 80–80N are positioned within arcuate cut-out 26 of plate segments 14–14N so as to include a space therebetween. The urethane 82 is applied to the liner bars so that it fills the space between adjacent liner bars within arcuate cut-out 26. Liner bars 80–80N are preferably coated with urethane in pairs such that two adjacent liner bars are fused together. Urethane on one edge of the formed pair bridges the space between adjacent pairs of liner bars. It is understood, however, that liner bars 80–80N could be coated individually or in groups greater than two depending upon the application.

Liner bars 80–80N serve to distribute the pressure applied against the pipe by plate segments 14–14N in order to avoid transverse scratching or scarring of the exterior of pipe 12 which could occur by direct contact between plate segments 14–14N and the exterior of pipe 12.

Each individual liner bar 80 is of a length sufficient to span the distance between first end plate 16 and second end plate 18. Each liner bar 80 includes a tab on each end wherein the liner bar is bent beyond the last plate segment on the end of flexible die 8.

FIG. 3 depicts liner bars 80–80N encoated with urethane 82 in contact with the exterior surface of pipe 12 such as in the process of bending.

Figure 9:
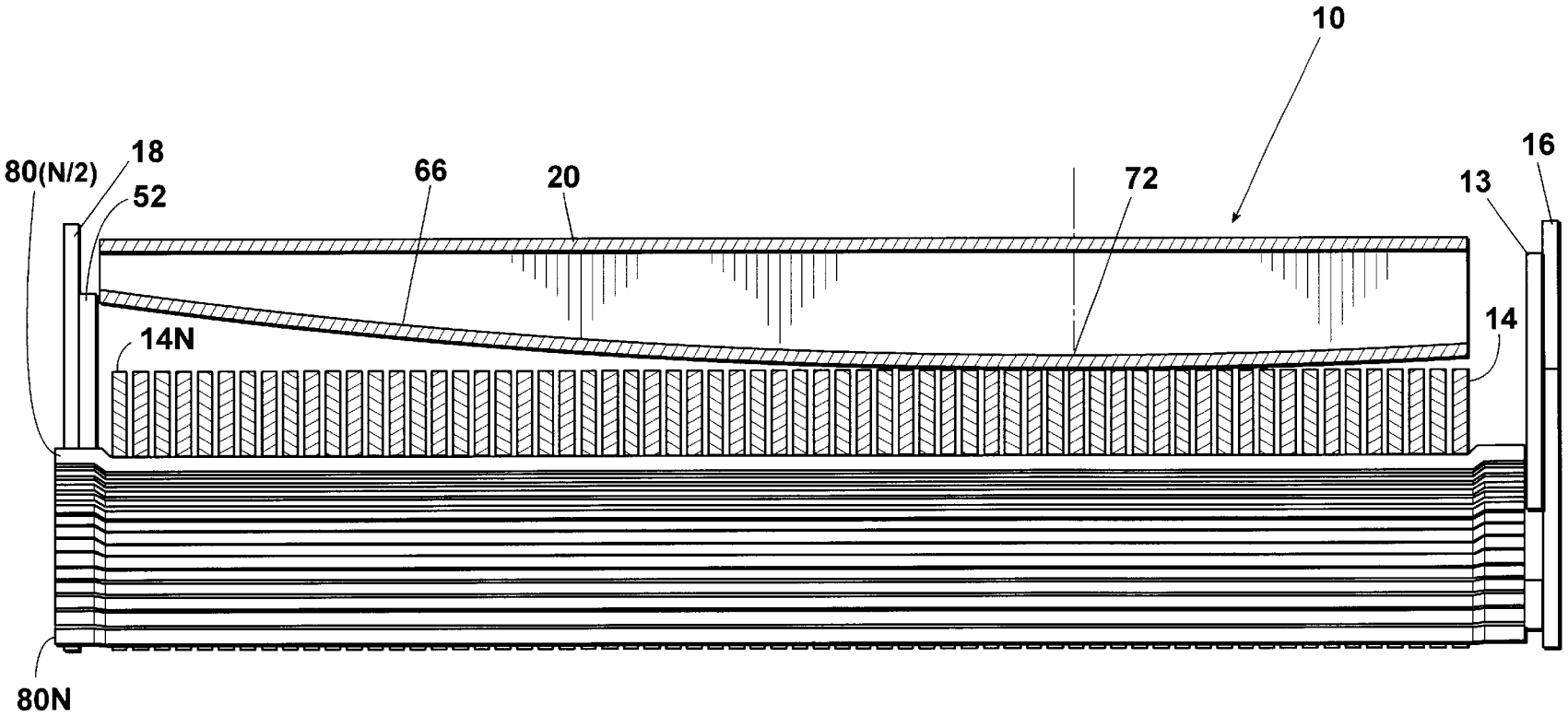
FIG. 9 is a section of the die of FIG. 1 illustration placement of the liner bars without a coating thereon and without the retaining bands on each end.

Taking FIG. 4 in combination with FIG. 9, wherein FIG. 9 is a cross-section showing liner bars 80–80N in place. FIG. 4 illustrates the manner in which liner bars 80–80N are retained within die assembly 10. The crimp segments of each liner bar 80–80N extends beyond first end plate 16 on the pin-up end and beyond second end plate 18 on the stiffback end. First end plate 16 and second end plate 18 include a pair of tabs 84 positioned on its face with one on the side of tie rod 30 and one on the side of tie rod 32. Tabs 84 extend outwardly from first end plate 16 and second end plate 18 in the pin-up and stiffback directions, respectively. A retaining ring 86 is positioned adjacent liner bars 80–80N and secured to tabs 84 such as by bolting. Retainer ring 86 thereby clamps the crimp segments of liner bars 80–80N between itself and arcuate cut-out 26 of first end plate 16. In likewise fashion, a retaining ring is secured to the crimp segmentss of second end plate 18 thereby clamping the crimp segments on the opposite ends of liner bars 80–80N between itself and the arcuate cut-out of second end plate 18. Liner bars 80–80N are thereby clamped on each end of die assembly 10. In the preferred embodiment, the crimp segments crimp segments of liner bars 80–80N are not coated with urethane. Although liner bars 80–80N are clamped to first end segment 16 and second end segment 18, they are capable of movement within the circumference of arcuate cut-out 26.

Figure 10:
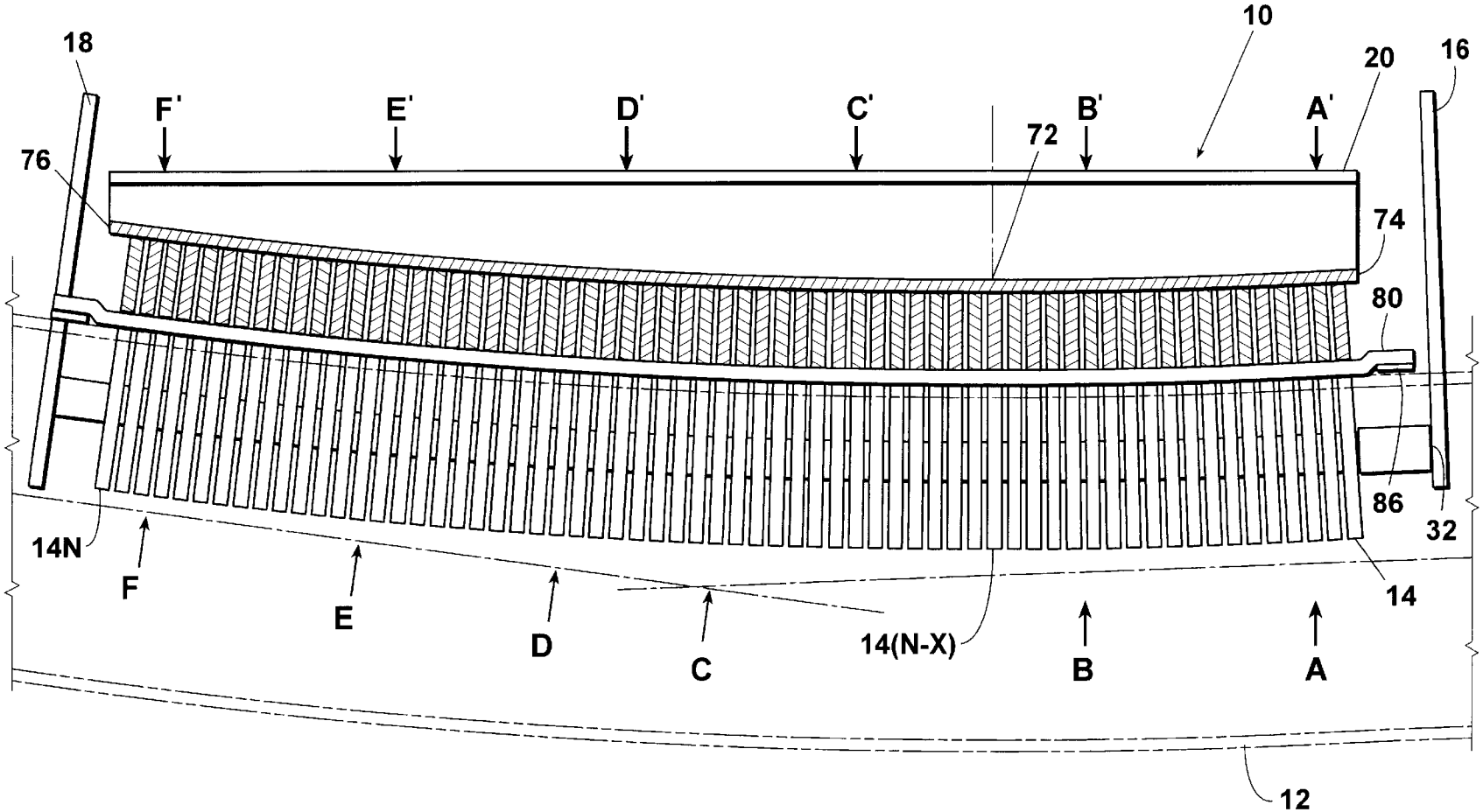
FIG. 10 is a schematic illustrating the die of FIG. 1 in a flex position with only one flex bar in place.

FIG. 10 is schematic view of the die assembly 10 of the present invention to illustrate the manner in which the flexible die 8 acts against pipe 12 and spring plates 66 in order to produce a uniform bend in pipe 12. The die apparatus 10 is shown in FIG. 10 in a full flex position. In the position of FIG. 10, the pin-up applies a force in the direction identified as A and B upon pipe 12. In response, pipe 12 begins to bend and transfers the force against plate segments 14 to 14(N−x) (wherein x equals the number of plate segments between fulcrum point 72 and plate segment 14N). Tie rod 32 then flexes in response to forces A and B applied to plate segments 14 through 14(N−x) against radius plate 66 of eggcrate assembly 20. Eggcrate assembly 20 applies resistive forces A' and B' back upon plate segments 14–14(N−x). Since plate segments 14–14(N−x) are free floating and spaced along tie rod 32, the ends of plate segments 14–14(N−x) adjacent to pipe 12 fan apart and distribute the resistive forces A' and B' substantially equally among plate segments 14–14(N−x). This force is further distributed through liner bars 80 which are placed transverse to the plate segments 14. As a result, the forces causing pipe 12 to bend are distributed evenly along the bend corresponding to the number of plate segments. The result is the bend in pipe 12 conforms to the radius of curvature of spring plate 66 between fulcrum 72 and pin-up end 74.

In like manner, the stiffback of the bending apparatus applies a bending force to pipe 12 represented as C, D, E, and F in FIG. 10. This force is transferred from pipe 12 to plate segments 14(N−x) through 14N. This force is then transferred to spring plate 66 of eggcrate assembly 20. Eggcrate assembly 20 applies a resistive force represented as C', D', E', F' against plate segments 14(N−x) through 14N. Plate segments 14(N−x) through 14N being free floating on tie rod 32 and spaced from one another assume the radius of curvature of spring plate 66 between fulcrum 72 and stiffback end 76. In response to the flex of tie rod 32, the portions of the plate segment adjacent the pipe fan out such that the resistive force transferred through plate segments 14(N−x) through 14N are distributed substantially equally among plate segments 14(N−x) through 14N. Liner bars 80 further distribute the bending force along the length of pipe 12 where the bend is achieved. A smooth, uniform bend in pipe 12 substantially equal to the radius of curvature of spring plate 66 between fulcrum 72 and stiffback end 76 is obtained in pipe 12.

The optimal radius of curvature for the spring plate 22 on the eggcrate assembly 20 is dependent upon the diameter of the pipe. The amount of bend per arc foot is dependent upon factors such as the wall thickness of the pipe, the yield point of the pipe material and the use of a pipe mandrel. However, for the purpose of exemplification, it has been found that where all factors are equal, and the die of the present invention is used, the recommended die radius was determined to be 1.33 times that of the conventional die. For example, for 12" X-52 pipe having a wall thickness of ⅜" (12 ⅜" O.D.), the recommended conventional die radius is 12'9". However, using the die of the present invention for the same pipe, a die radius of 17'0" has been found to be acceptable. As a result, where the recommended bend per arc foot is 2.3° using a conventional static die, the bend per arc foot using the die of the present invention was determined to be 5.5°.

For the purpose of exemplification, a die assembly such as die assembly 10 intended to bend 12 inch x-52 pipe (12 ⅜" D) may have the following suitable configuration:

| | |
|---|---|
| Number of ½ wide plate segments | 64 |
| Spaced apart | ⅛" |
| with a 7" radius on arcuate cut-out | |
| Number of liner bars | 30 |
| Spaced apart | ⅛" |
| coated with 90 durometer urethane | |
| formed in pairs | |
| Number of 32" spring plates | 4 |
| formed of 5160 spring steel having a | |
| Radius of curvature of | 17' 0" |
| with fulcrum point 12" from pin-up end | |

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A die for a machine used to bend a length of pipe, comprising:

a frame;

at least one spring plate having a length and a radius of curvature along said length;

said at least one spring plate supported against said frame wherein said frame and said at least one spring plate together form an eggcrate assembly;

at least one tie rod;

said at least one tie rod having a longitudinal axis;

a plurality of plate segments positioned along said at least one tie rod;

said at least one tie rod and said plurality of plate segments together form a flexible die;

said eggcrate assembly and said at least one tie rod being positioned in the die such that the longitudinal axis of said at least one tie rod is parallel to said length of said at least one spring plate.

2. The die of claim 1 wherein said at least one tie rod is flexible.

3. The die of claim 2 including a pair of tie rods having parallel longitudinal axes.

4. The die of claim 2 wherein each of said plurality of plate segments is spaced from its adjacent plate segment along the length of said at least one tie rod.

5. The die of claim 4 including a spacer between each adjacent plate segment.

6. The die of claim 5 wherein each of said plurality of plate segments includes:

an arcuate cut out which is sized and shaped to conform to the external circumference of the pipe such that said arcuate cut out contacts said pipe;

a planar top surface which is disposed opposite said at least one spring plate such that while said arcuate cut out contacts said pipe, said planar top surface contacts said at least one spring plate upon flex of said at least one tie rod.

7. The die of claim 5 wherein each of said plurality of plate segments is free floating on said at least one tie rod such that as said at least one tie rod is flexed, each of said plurality of plate segments is free to contact both said at least one spring plate and the pipe.

8. The die of claim 6 including a plurality of liner bars in said flexible die positioned between said arcuate cut outs of said plurality of plate segments and the pipe and aligned parallel to said longitudinal axis of said at least one tie rod.

9. The die of claim 8 wherein said plurality of liner bars are coated with a material to prevent scratching and scaring of the pipe.

10. The die of claim 9 wherein the material is urethane.

11. The die of claim 1 including means to secure said plurality of plate segments on said at least one tie rod.

12. The die of claim 1 wherein said eggcrate assembly and said flexible die are encompassed and supported in an exterior housing.

13. A die for a machine used to bend a length of pipe, comprising:

a frame;

at least one spring plate having a length and a radius of curvature along said length;

said at least one spring plate supported against said frame wherein said frame and said at least one spring plate together form an eggcrate assembly;

at least one tie rod;

said at least one tie rod having a longitudinal axis;

a plurality of plate segments positioned along said at least one tie rod;

each of said plurality of plate segments including an arcuate cut out therein;

said at least one tie rod and said plurality of plate segments together form a flexible die;

said eggcrate assembly and said at least one tie rod being positioned in the die such that the longitudinal axis of said at least one tie rod is parallel to said length of said at least one spring plate;

a plurality of liner bars oriented substantially parallel to said at least one tie rod lining and movably retained within said arcuate cut outs of said plurality of plate segments.

14. The die of claim 13 wherein each of said plurality of liner bars includes a crimp segment on at least a first end such that a retainer ring movably clamps said plurality of liner bars between said retainer ring and said arcuate cut outs in said plurality of plate segments.

15. The die of claim 14 wherein each of said liner bars includes a crimp segment on a first and a second end such that a retainer ring movably clamps said plurality of liner bars between said retainer ring and said arcuate cut outs on each end of said die.

16. A method of replacing a bending die in a pipe bending machine that includes a main frame supporting a bending die, a stiffback, and stiffback clamp, a pin-up shoe and pin-up clamp and associated power actuating means, such method including:

removing the existing bending die and replacing the existing bending die with a die comprising:

a frame;

at least one spring plate having a length and a radius of curvature along said length;

said at least one spring plate supported against said frame wherein said frame and said at least one spring plate together form an eggcrate assembly;

at least one tie rod;

said at least one tie rod having a longitudinal axis;

a plurality of plate segments positioned along said at least one tie rod;

each of said plurality of plate segments including an arcuate cut out therein;

said at least one tie rod and said plurality of plate segments together form a flexible die;

said eggcrate assembly and said at least one tie rod being positioned in the die such that the longitudinal axis of said at least one tie rod is parallel to said length of said at least one spring plate;

a plurality of liner bars oriented substantially parallel to said at least one tie rod lining and movably retained within said arcuate cut outs of said plurality of plate segments.

17. The method of claim 16 wherein each of said plurality of liner bars in said die also includes a crimp segment on at least a first end such that a retainer ring movably clamps said plurality of liner bars between said retainer ring and said arcuate cut outs in said plurality of plate segments.

18. The method of claim 17 wherein each of said liner bars includes a crimp segment on a first and a second end such that a retainer ring movably clamps said plurality of liner bars between said retainer ring and said arcuate cut outs on each end of said die.

* * * * *